United States Patent [19]

Bruck

[11] Patent Number: 4,657,292

[45] Date of Patent: Apr. 14, 1987

[54] LATCHING MECHANISM FOR A PIVOTALLY MOUNTED DOOR

[75] Inventor: Gary A. Bruck, Fraser, Mich.

[73] Assignee: Chrysler Motors Corporation, Highland Park, Mich.

[21] Appl. No.: 780,865

[22] Filed: Sep. 27, 1985

[51] Int. Cl.[4] ..... E05C 19/02

[52] U.S. Cl. ..... 292/80; 292/DIG. 4

[58] Field of Search ..... 292/80, 92, 201, DIG. 4, 292/231, 122

[56] References Cited

U.S. PATENT DOCUMENTS

| | | | |
|---|---|---|---|
| 1,188,996 | 4/1967 | Moody et al. . | |
| 1,738,531 | 12/1929 | Grace | 292/DIG. 4 X |
| 1,828,082 | 10/1931 | Stonebridge | 292/DIG. 4 X |
| 2,535,639 | 12/1950 | Lauer | 292/DIG. 4 X |
| 2,750,219 | 6/1956 | Bleam | 292/DIG. 4 X |
| 3,189,374 | 6/1965 | Mertes | 292/80 |
| 3,854,784 | 12/1974 | Hunt et al. | 292/DIG. 4 X |
| 4,328,985 | 5/1982 | Logan | 292/92 X |
| 4,497,393 | 2/1985 | Brems | 188/322.5 |

*Primary Examiner*—Richard E. Moore

*Attorney, Agent, or Firm*—Edward A. Craig

[57] ABSTRACT

A latching mechanism for a pivotally mounted door of an interior compartment, such as a compartment of a vehicle, is provided. The latching mechanism includes a latch mountable within the compartment and a striker plate mountable on the door. The latch includes a latching element and with the striker plate has catch means to engage the latching element upon pushing of the door to a closed position to thereby latch the door closed. The latch includes spring means which are effective to disengage the latching element upon pushing on the door after the door has first been closed and latched. The latch also includes retardation means connected to the latching element. The retardation means is effective to delay disengagement of the latching element and the catch for a short time after the door is pushed when the door is in the closed and latched condition.

4 Claims, 9 Drawing Figures

LATCHING MECHANISM FOR A PIVOTALLY MOUNTED DOOR

BACKGROUND OF THE INVENTION

Interior compartments with pivotally mounted doors have traditionally been provided in the forward portion of cars and trucks. These compartments are for the storage of articles which are useful to the driver and passengers. For example, glove boxes have been provided in most cars and trucks. Currently, additional compartments are also being provided in other locations such as the lower forward console and the like for storage of various additional items such as audio tapes, garage door openers and the like.

It has been desired to provide the doors of such compartments with latching means for opening and closing the doors which do not require the use of a handle or trigger located on the door as is common with conventional latch systems.

In accordance with the present invention, a latching mechanism is provided which is fixed to the top of the door frame and engages a fixed striker cam located on the top edge of the door. The door is spring-loaded outwardly and moves in and out relative to the latch-spring assembly. The latch spring follows a complete cycle around the striker cam when the door is opened and then closed. The latch system may be referred to as a "push-push" latch.

The current regulation relating to such doors is that during an instrument head impact test, all instrument panel compartment doors must remain in a closed and latched condition. A push-push latch system inherently opens upon impact. Upon impact, the compartment door experiences an inertia loading which causes an inward deflection of the door. This deflection of the door allows the latch system to move to an unlatched condition, which is of course desired in accordance with the present invention, although not as a result of such an impact or random jolting of the vehicle.

In order to prevent opening of the door under conditions of a head impact test or upon vehicle jolting, a viscous damper has been provided such that the door travels in and back out before the latch system can move to an unlatched position.

Another benefit of using a latch-spring damper system is that of decreased operating noise during the latch cycling period. Without use of a damper system, the latch may result in noisy cycling because of the high speed at which the latch-spring snaps around the corners of the striker cam. The use of a damper reduces operating noise considerably by slowing the latch spring motion and reducing vibrations of the latch spring itself.

Viscous dampers are, of course, well known in the art. The principles thereof are set forth in U.S. Pat. No. 4,497,393. Additionally, the use of striker cam means with spring loaded latching structure is also known, as exemplified by British Pat. No. 1,188,996. However, such structures have not been proposed in the past for a pivotal vehicle compartment door to prevent undesired unlatching and reduction in noise levels of the catch mechanism.

SUMMARY OF THE INVENTION

A latching mechanism for a pivotally mounted door of an interior compartment of a vehicle is provided. The latching mechanism includes spring means which are mountable between the door and the compartment for biasing the door to open. A latch spring arm is mountable within the compartment. A striker cam plate is mountable on the door. A latching element is carried by the latch spring arm. The striker cam plate has a first cam surface positioned to contact a latching element upon pushing of the door closed against the action of the spring means and cause the latching element to cam thereon with resultant deflection of the latch-spring arm permitting full closure of the door. The striker cam plate has a first cam lobe at the termination of the first cam surface. The latching element passes over the first cam lobe upon full closure of the door. The striker cam plate has a second cam lobe and a depression between the cam lobes. A detent is mountable on the door in alignment with the depression. The detent blocks passage of the latching element after it passes the first cam lobe with the door fully closed. The door is biased to a slightly open position by the spring means after pushing on the door ceases. The detent moves out of blocking position upon such slight opening of the door permitting the latching element to be moved into the depression between the cam lobes as a consequence of the biasing action of the deflected latch spring arm. The second cam lobe blocks passage of the latching element after it moves into the cam depression with the door in a slightly open position to thereby latch the door in a closed position. The second cam lobe moves out of blocking position upon again pushing of the door to the fully closed position against the action of the spring mean. This permits the latching element to pass over the second cam lobe as a consequence of the biasing action of the deflected latch spring arm to unlatch the door. Retardation means are connectable between the latch spring arm and the compartment. The retardation means is effective to slow down movement of the latch spring arm to delay passage of the latching element past the second cam lobe for a short time period after the door is pushed to the fully closed position.

The retardation means includes a pair of relatively movable members. A viscous fluid is provided between these members to inhibit movement of the members with respect to each other. One of these members is connected to the latching element and the other of these members is connectable to the compartment.

BRIEF DESCRIPTION OF A PREFERRED EMBODIMENT

Figure 1:
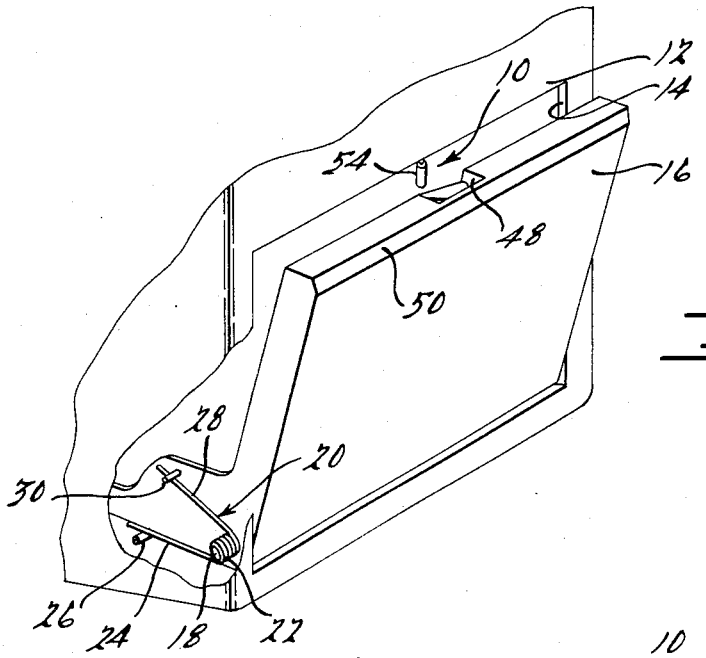
FIG. 1 is a view in perspective of a vehicle interior compartment with the door partially open and with the latching mechanism forming one embodiment of the present invention mounted thereon.

The latching mechanism 10 of the present invention is adapted for use in connection with an interior compartment 12 of a vehicle, such as a glove box, such as are conventionally provided in vehicles such as automobiles and trucks. Such compartments are normally provided on the instrument panel or consoles in the forward portion of the vehicle. The compartment 12 has an access opening 14 which is normally closed by a door 16. The door 16 is pivotally mounted at 18 to the structure of the compartment 12 so that it may be pivoted from the open to the closed position.

A spring 20 biases the door 16 towards the open position. The spring 20 functions to maintain the door 16 in the latched condition when the door is closed and as an aid to easy opening of the door after it has been unlatched. The spring 20 has a central coiled section 22 which is received on pivot structure 18. One arm 24 extends from coil 22 to a position over a pin 26 which is mounted on the structure of the compartment 12. A second arm 28 extends from the coil 22 beneath a second pin 30 which is mounted on the compartment door 16. The arms 24, 28 are constrained by the pins 24, 30 to cause the coil 22 to tighten thus constantly exerting a force tending to spread the arms 24, 28 apart to thereby bias the door 16 toward the open position.

The construction of the latching mechanism 10 may best be seen in FIGS. 2, 7, 8 and 9. As will be therein noted, the latching mechanism 10 includes an elongated plate 32. The plate 32 is secured to structure 34 of the compartment by means of a pair of screws 36, 38 as may be noted in FIGS. 7 and 8. The plate 32 has a first straight portion which is mounted in the compartment at substantially right angles to the plane of the door 16. The plate 32 has an upwardly angled portion 40 intermediate the ends thereof which terminates in a third portion 42 which extends forwardly towards the compartment access opening 14 and terminates short thereof.

An elongated latch spring arm 44 is provided on the underside of the plate 32. The latch spring arm 44 is secured to the inner end of the plate 32 by means of a rivet 46. The arm 44 extends from the rivet 46 and terminates at a point above a notch 48 which is provided on the upper edge of the compartment door 16. The notch 48 faces towards the interior of the compartment with a solid portion 50 of the door 16 masking the notch from external view. The arm 44 has a turned down portion 52 which extends into notch 48. A cylindrical cam follower element 54 is provided on the turned down portion 52. A pair of longitudinally spaced apart blocks 56, 58 are secured to the underside of the plate 32. One block 56 is provided on one side and adjacent to the arm 44 while the other block 58 is provided on the other side and adjacent to the arm 44. The blocks 56, 58 serve as positioning elements to center the spring arm when undeflected in a preselected position as will be noted in FIG. 2. This position is slightly off-center of the plate 32. The arm 44 may be deflected in either direction in the latching and unlatching procedure but will always tend to return to the position shown in FIG. 2. This feature forms part of the latching and unlatching system.

A striker cam plate 60 is secured to the bottom of the notch 48. The plate 60 has a first cam surface 62 which faces the spring arm 44. The cam surface 62 is angled outwardly from the compartment extending from a point 64 which is adjacent to the cam follower element 54 upon initial closing of the door 16 to a point 66 within the notch 48. A cam lobe 68 is there provided. The cam lobe 68 is followed by a depression 70 which faces outwardly with respect to the compartment. A detent element 72 is secured within the notch 48 and is oppositely disposed and spaced from the depression 70. The depression 70 terminates in a second cam lobe 74. A cam surface 76 extends from lobe 74 at a angle back to the cam surface 62 joining the surface at the point 64 which thereby defines the apex of oppositely inclined converging cam surface 62, 76.

Figure 2:
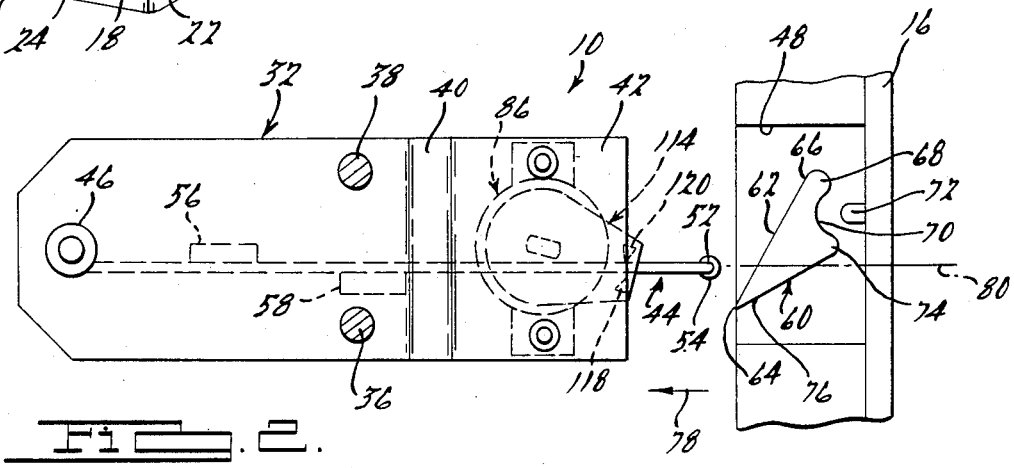
FIG. 2 is a top plan view of the latching mechanism illustrating the condition thereof just prior to closing of the door.
Figure 3:
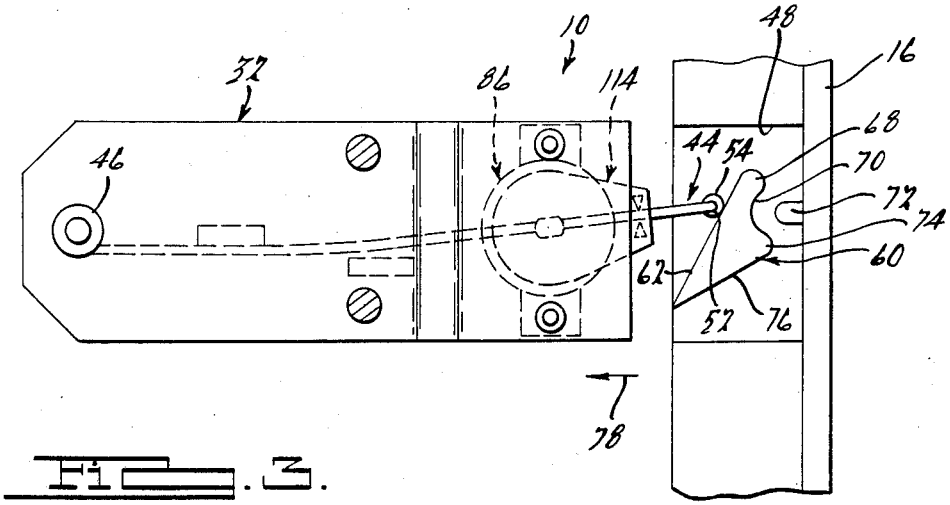
FIG. 3 is a top plan view similar to FIG. 2 illustrating the first stage of latching upon closing of the door.
Figure 4:
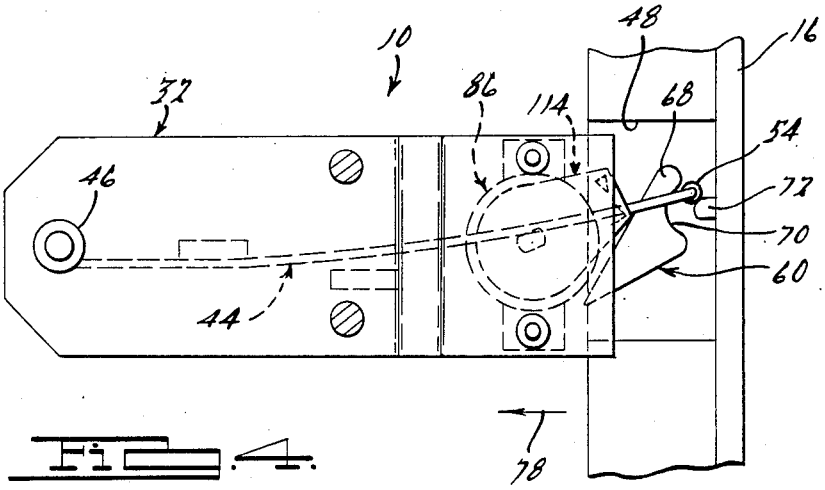
FIG. 4 is a top plan view similar to FIG. 2 illustrating the second stage of latching upon closing of the door.

The latching and unlatching action may now be understood. With the door 16 in the open position as shown in FIG. 2, the cam follower element 54 is directly in line with the cam surface 62 at a point slightly offset from the apex 64. When the door 16 is moved in the direction of arrow 78 by a manual push in opposition to the force of spring 20, the cam follower element 54 will eventually contact cam surface 62 and move along this cam surface as shown in FIG. 3. This movement will cause deflection of the spring arm 44 as illustrated in FIG. 3. As the door 16 is pushed further inwardly as shown in FIG. 4 in the direction of arrow 78, the cam follower element 54 will pass over the cam lobe 68 and into the depression 70. However, the detent element 72 will obstruct movement of the cam follower element 54 from entirely entering the depression 17 until the closing pressure is released. Otherwise, the spring arm would drive the cam follower element 54 through the depression 70 over the cam lobe 74 back to its initial position and release the door.

As will be noted in FIG. 2, the center line of the spring arm 44 when undeflected in its preselected position, as represented by the line 80, projects just past the second cam lobe 74. As will be recalled, the spring arm 44, which is offset from the center of the plate 32, normally assumes the position shown in FIG. 2. Thus, if the detent element 72 were not provided, the door 16 would not be latched.

After the manual pressure used to close the door 16 is released, the spring 20 biases the door 16 in the direction of arrow 82 towards the open position. The door 16 moves slightly towards the open position allowing the cam follower element 54 to pass by the detent element 72 into the depression 70. However, the cam follower element 54 cannot now pass over the lobe 74 because the lobe 74 has been moved from the position indicated by dotted lines away from the cam follower element to the position shown in full lines which is beyond the length of the latch spring arm 44 thus preventing unlatching.

When it is desired to open the door 16, the door is again pushed in the direction of arrow 78. The cam lobe 74 is thus moved closer to the cam follower element 54, back to the position shown in dotted lines in FIG. 5. In this position, it is possible because of the length of the spring arm 44 for the cam follower element 54 to pass over the lobe 74. As soon as it passes over the lobe 74, and upon release of the door 16, the door 16 will move in the direction of arrow 84 as shown in FIG. 6, towards the open position. The cam follower element 54 will then pass over the cam lobe 76 as shown in FIG. 6, with the spring arm 44 returning to its normal position. At this time, the door 16 is free to move under the action of spring 20 to the fully open position.

Figure 9:
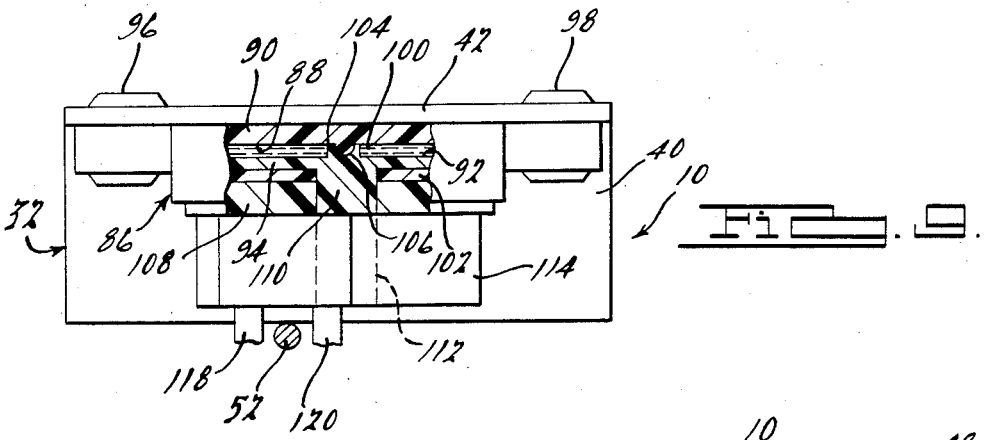
FIG. 9 is an end view viewed from the right of FIG. 8 with portions of the rotary retardation device broken away for the purpose of clarity.
Figure 7:
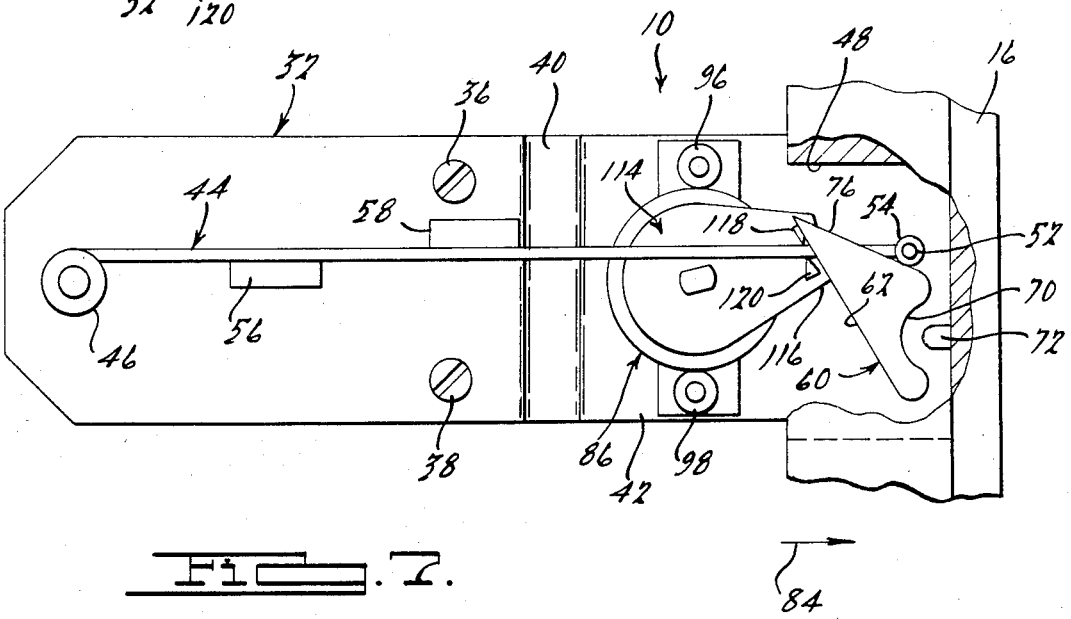
FIG. 7 is a bottom plan view illustrating unlatching as in FIG. 6.

Means are provided for retarding the action of the spring arm 44 to prevent opening of the door 16 upon being impacted for a short duration as might be caused by being hit by the head of the occupant of a vehicle during a crash or by jolting of the vehicle. These means comprise a rotary retardation device 86. The rotary retardation device 86 is of the type which utilizes viscous fluid which is sealed in a cavity between relatively movable rotary members. The viscous fluid operates in shear between the fixed surface, in the present case, as shown in FIG. 9, provided by the surface 88 of the housing 90 and a moving surface, in the present case the surface 92 of rotary member 94. The viscous fluid functions to slow dow the angular velocity of the relatively movable parts. In this manner, an impact of short duration will not cause the door 16 to open. It is necessary to apply manual inwardly pushing pressure on the door for a time sufficient to permit movement of the cam follower element 54 past the lobe 74 in order for the door to be opened.

The housing 90 is secured to the plate portion 42 by means of rivets 96, 98. Viscous fluid 100 is provided between the surfaces 88, 92. The viscous fluid 100 may be, for example, a silicone oil. A seal member 102 is provided on the opposite side of the rotary member 94. The rotary member 94 has a hub 104 into which is received a rounded projection 106 extending from the housing surface 88. This arrangement guides the rotary member 94 in its rotating action.

A housing cap member 108 is provided beneath the seal member 102 to complete the housing structure. A cylindrical shaft 110 extends from the rotary member 94 through openings in the seal member 102 and the housing cap member 108 to a point outside of the housing. The external portion 112 is elongated in cross section to provide keymeans for operative connection to a plate 114. The plate 114 thus will rotate along with rotary member 94. The plate 114 is located above and adjacent to the spring arm 44. As will be noted in FIGS. 7 and 8, the plate 114 is generally circular having a projection 116 extending therefrom. A pair of generally triangular retainers 118, 120 extend from projection 116. One retainer 118 is located to one side of the spring arm 44 while the other retainer 120 is positioned on the opposite side of the spring arm.

Figure 5:
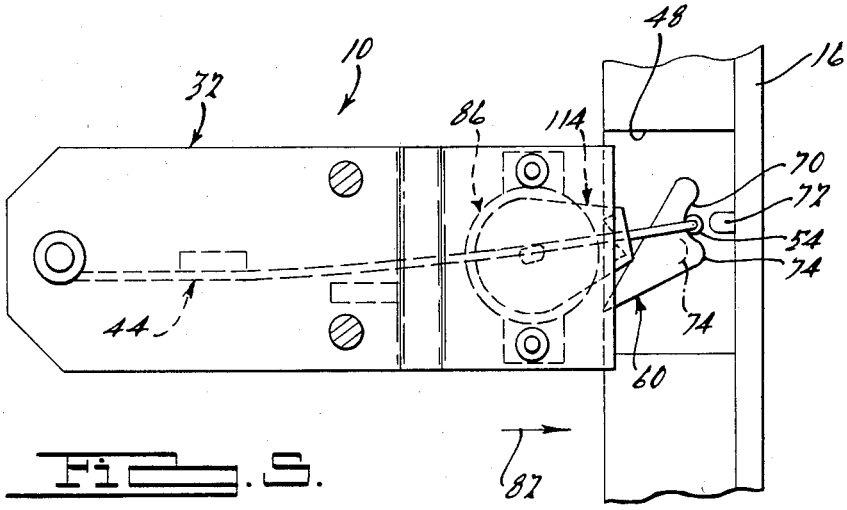
FIG. 5 is top plan view similar to FIG. 2 illustrating the door in the closed and latched condition.
Figure 6:
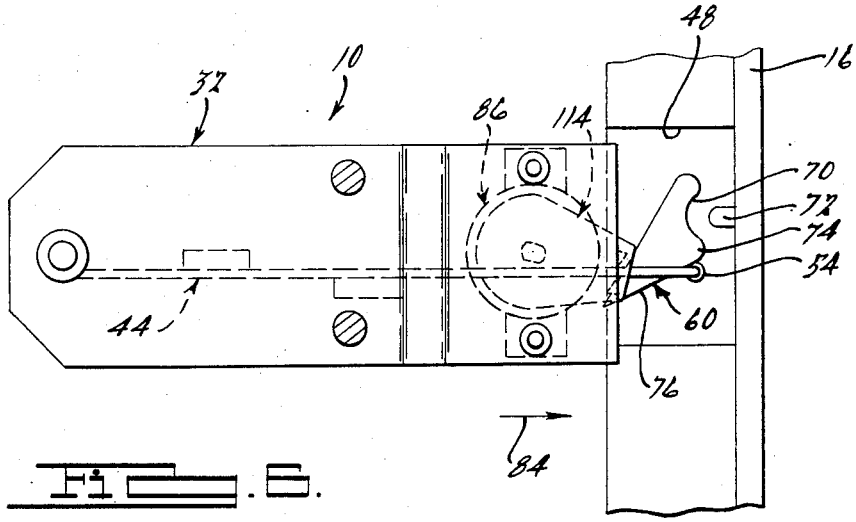
FIG. 6 is a top plan view similar to FIG. 2 illustrating unlatching of the door.
Figure 8:
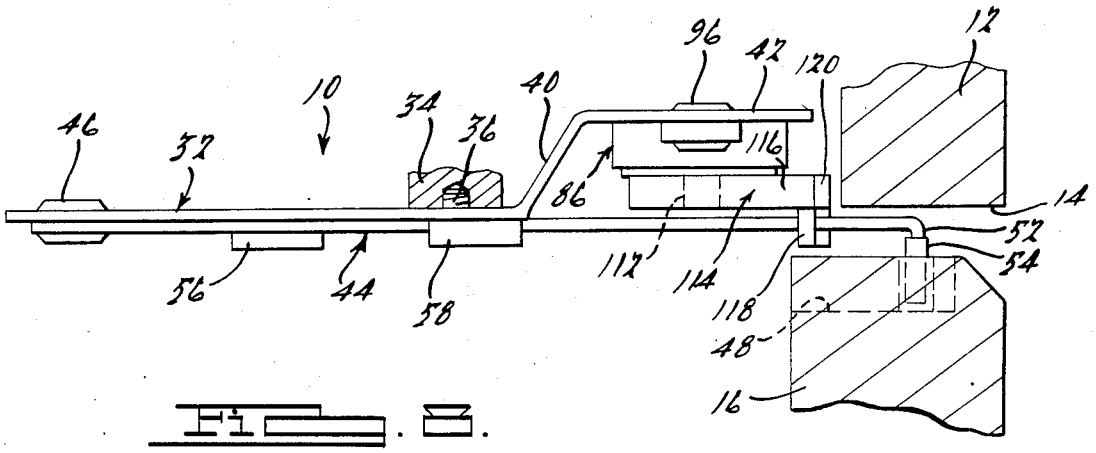
FIG. 8 is a side elevational view of the latching mechanism with the door in the closed and latched position.

In operation, when the spring arm 44 attempts to return to its normal position, after being latched as shown in FIG. 5, the rotary retardation device 86 through the action of retainers 118, 120 will inhibit spring arm motion. A normal pushing force against the door 16 will cause the door to unlatch and open. However, an impact of very short duration will not result in opening of the door because the spring arm will not have time to move the cam follower element 54 past the cam lobe 74. For example, a head impact on the door 16 resulting from a crash may take a 40 milliseconds to move the door in and back out after the impact is relieved. The rotary retardation device 86, in one example, retards door unlatching for a period of 400 milliseconds.

I claim:

1. In combination with a door pivotally mounted on an interior compartment of a vehicle, a latching mechanism comprising spring means mounted between the door and the compartment for biasing the door to open, a latch spring arm mounted within the compartment, a striker cam plate mounted on the door, a latching element carried by the latch spring arm, the striker cam plate having a first cam surface positioned to contact the latching element upon pushing of the door to close against the action of the spring means and cause the latching element to cam thereon with resultant deflection of the latch spring arm permitting full closure of the door, the striker cam plate having a first cam lobe at the termination of the first cam surface, the latching element passing over the first cam lobe upon full closure of the door, the striker cam plate having a second cam lobe and a depression between the cam lobes, a detent mountable on the door in alignment with the depression, the detent blocking passage of the latching element after it passes over the first cam lobe with the door fully closed, the door being biased to a slightly open position by the spring means after pushing thereon ceases, the detent moving out of blocking position upon such slight opening of the door permitting the latching element to be moved into the depression between the cam lobes as a consequence of the biasing action of the deflected latch spring arm, the second cam lobe blocking passage of the latching element after it moves into the cam depression and with the door in a slightly open position to thereby latch the door in a closed position, the second cam lobe moving out of blocking position upon again pushing of the door to the fully closed position against the action of the spring means thereby permitting the latching element to pass over the second cam lobe as a consequence of the biasing action of the deflected latch spring arm to unlatch the door, and retardation means connected between the latch spring arm and the compartment, the retardation means being effective to slow down movement of the latch spring arm to delay passage of the latching element past the second cam lobe for a short time period after the door is pushed to the fully closed position.

2. A latching mechanism as defined in claim 1, further characterized in that the retardation means includes a pair of relatively movable members, a viscous fluid provided between said members operable in shear between said members to inhibit the movement of the members with respect to each other, one of said members being connected to the latching element and the other of said members being connected to the compartment.

3. A latching mechanism ad defined in claim 1, further characterized in that said latching mechanism includes a body which is mounted within the compartment, said latch spring arm having one end connected to the latching body while the other end carries the latching element, a pair of spaced apart positioning elements provided on the latching body, one of said positioning elements being located adjacent to the latch spring arm on one side thereof, the other of said positioning elements being located adjacent to the latch spring arm on the other side thereof to thereby permit deflection of the spring arm but cause the spring arm to assume a preselected position when it is not deflected, said preselected position resulting in the latching element to be located past the second cam lobe when the latch spring arm is undeflected.

4. A latching mechanism as defined in claim 2, further characterized in that the retardation means is a rotary retardation device, the pair of relatively movable members being relatively rotatable thereon, the other of said members being connected to the latch spring arm so as to move therewith during deflection of the latch spring arm and during return of the latch spring arm from a deflected position.

* * * * *